US006641370B2

(12) United States Patent
Kim

(10) Patent No.: US 6,641,370 B2
(45) Date of Patent: Nov. 4, 2003

(54) VACUUM PUMP APPARATUS HAVING IMPROVED SEALING STRUCTURE

(75) Inventor: Deok-Kyeom Kim, Incheon (KR)

(73) Assignee: Woosung Vacuum Co., Ltd., Incheon (KR)

( * ) Notice: Subject to any disclaimer, the term of this patent is extended or adjusted under 35 U.S.C. 154(b) by 109 days.

(21) Appl. No.: 09/924,680

(22) Filed: Aug. 9, 2001

(65) Prior Publication Data

US 2002/0197168 A1 Dec. 26, 2002

(30) Foreign Application Priority Data

Jun. 26, 2001 (KR) ..... 2001-36825

(51) Int. Cl.[7] ..... F04B 23/08
(52) U.S. Cl. ..... 417/199.1
(58) Field of Search ..... 417/199.1, 201, 417/423; 418/98, 102, 60, 94

(56) References Cited

U.S. PATENT DOCUMENTS 3,791,780 A * 2/1974 Fritch et al. ..... 418/60
5,181,414 A * 1/1993 Baret et al. ..... 73/40.7
6,149,414 A * 11/2000 Abelen et al. ..... 418/88
6,190,149 B1 * 2/2001 Richman ..... 418/94
6,409,477 B1 * 6/2002 Blecker et al. ..... 417/199.1

* cited by examiner

*Primary Examiner*—Teresa Walberg
*Assistant Examiner*—Vinod D. Patel
(74) *Attorney, Agent, or Firm*—Birch, Stewart, Kolasch & Birch, LLP

(57) ABSTRACT

The present invention relates to a vacuum pump apparatus which is capable of implementing a simple structure without a formation of an O-ring groove for engaging an O-ring therein, a lower fabrication cost, a stable sealing function, so that a maintenance cost is decreased. In the vacuum pump apparatus, a circular oil seal space is formed in assembling boundary surfaces of a cylinder, an oil pump housing and an oil pump cover which are sequentially assembled, wherein said oil seal space is communicated with an oil flow path through which an oil is supplied from the oil pump to each operating portion of a pump apparatus for thereby implementing a sealing effect based on an oil pressure in the vacuum pump which includes a cylinder for sucking and compressing a gas from a vacuum facility by a rotor, an oil pump housing which protects an oil pump installed at an end portion of a rotor shaft and an oil pump cover.

1 Claim, 5 Drawing Sheets

VACUUM PUMP APPARATUS HAVING IMPROVED SEALING STRUCTURE

BACKGROUND OF THE INVENTION

1. Field of the Invention

The present invention relates to a vacuum pump apparatus having an improved sealing structure, and in particular to an improved vacuum pump apparatus which is capable of implementing a simple structure without a formation of an O-ring groove for engaging an O-ring therein, a lower fabrication cost, and a stable sealing function and decreasing a maintenance cost.

2. Description of the Background Art

As shown in FIG. 5, a conventional vacuum pump apparatus includes cylinders 104 and 105 for sucking a gas from a vacuum apparatus connected with a pump suction port 102 based on the rotation of rotors 100 and 101, compressing the sucked gas and discharging the gas through a discharging port 103. In the conventional vacuum pump apparatus, the cylinders 104 and 105, a front cover member 106, and a pump cover 107 are assembled.

In addition, an oil pump 111 is installed for implementing a control operation of a reverse flow prevention valve 108 and a lubricating, sealing and cooling operation of each component of the pump apparatus 110. The oil from the oil pump 111 is supplied to each portion of the apparatus including the cylinders 104 and 105 through oil flow paths 112, 113, 114, 115 and 116.

Since the interior of the pump apparatus 110, namely, the cylinders 104 and 105 has a high temperature, an O-ring groove is formed in assembled boundary surfaces 117, 118 and 119 of the member 104, 105, 106 and 107, respectively, for sealing the same, and an O-ring 120 is engaged to each O-ring groove so that a gas(air) is not flown from the outside of the pump apparatus 110.

However, in the conventional sealing structure, since the O-ring grooves are formed in the assembled boundary surfaces 117, 118 and 119 of the members 104, 105, 106 and 107, a fabrication cost is increased. Since the O-ring 120 is directly contacted with an oil and gas, as the time is passed, the O-ring 120 is corroded for thereby decreasing a sealing performance of the O-ring 120. In addition, since the O-ring 120 is frequently changed, the pump apparatus 110 is frequently disassembled for thereby increasing a maintenance cost.

SUMMARY OF THE INVENTION

Accordingly, it is an object of the present invention to provide a vacuum pump apparatus which is capable of implementing a simple structure without a formation of an O-ring groove for engaging an O-ring therein, a lower fabrication cost and a stable sealing function and decreasing a maintenance cost.

To achieve the above object, there is provided a vacuum pump apparatus in which a circular oil seal space is formed in assembling boundary surfaces of a cylinder, an oil pump housing and an oil pump cover which are sequentially assembled, wherein said oil seal space is communicated with an oil flow path through which an oil is supplied from the oil pump to each operating portion of a pump apparatus for thereby implementing a sealing effect based on an oil pressure in the vacuum pump which includes a cylinder for sucking and compressing a gas from a vacuum facility by a rotor, an oil pump housing which protects an oil pump installed at an end portion of a rotor shaft and an oil pump cover.

BRIEF DESCRIPTION OF THE DRAWINGS

The present invention will become better understood with reference to the accompanying drawings which are given only by way of illustration and thus are not limitative of the present invention, wherein.

DETAILED DESCRIPTION OF THE PREFERRED EMBODIMENTS

The present invention will be explained with reference to the accompanying drawings.

Figure 1:
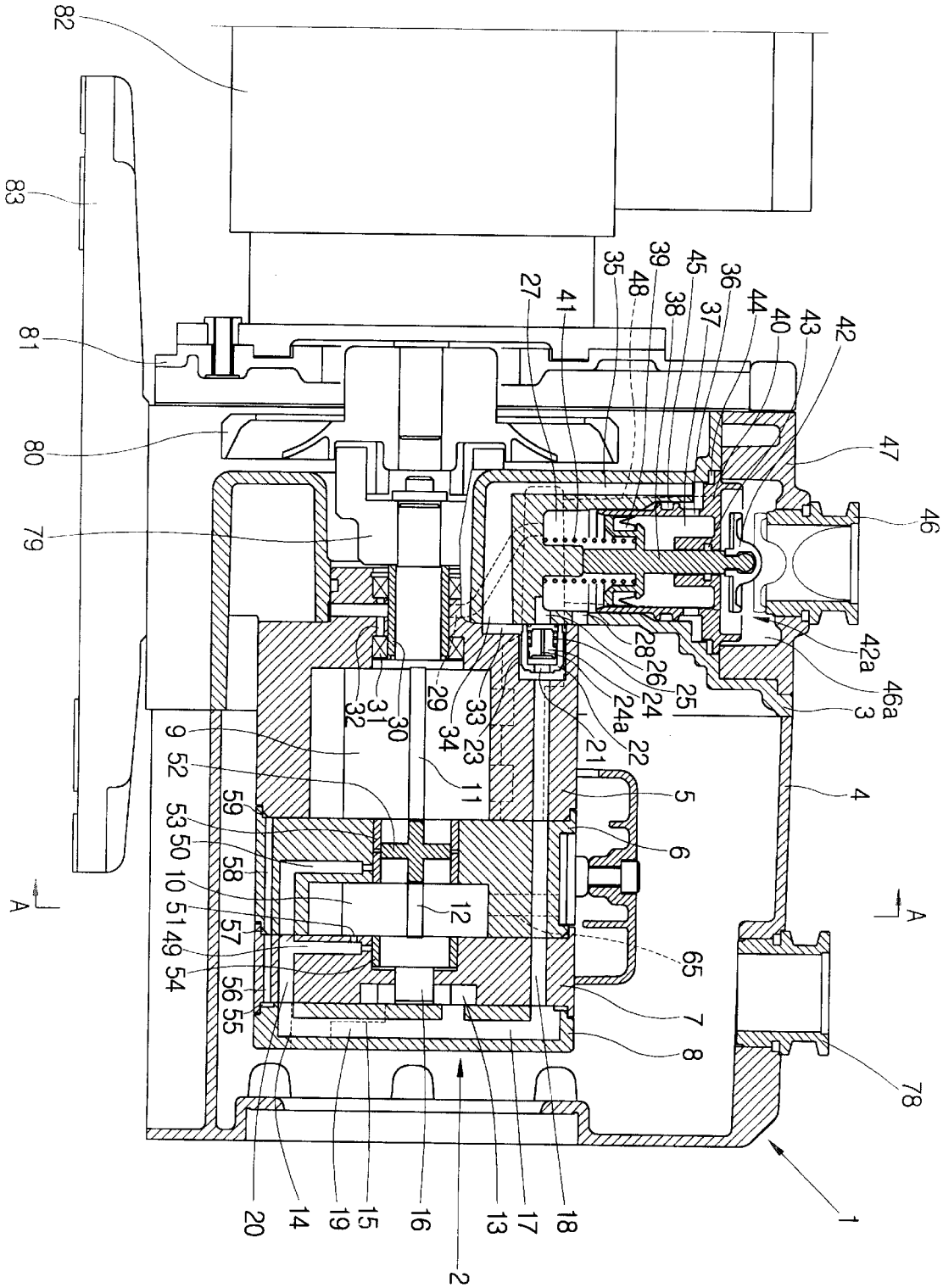
FIG. 1 is a view illustrating a vacuum pump apparatus according to the present invention.
Figure 2:
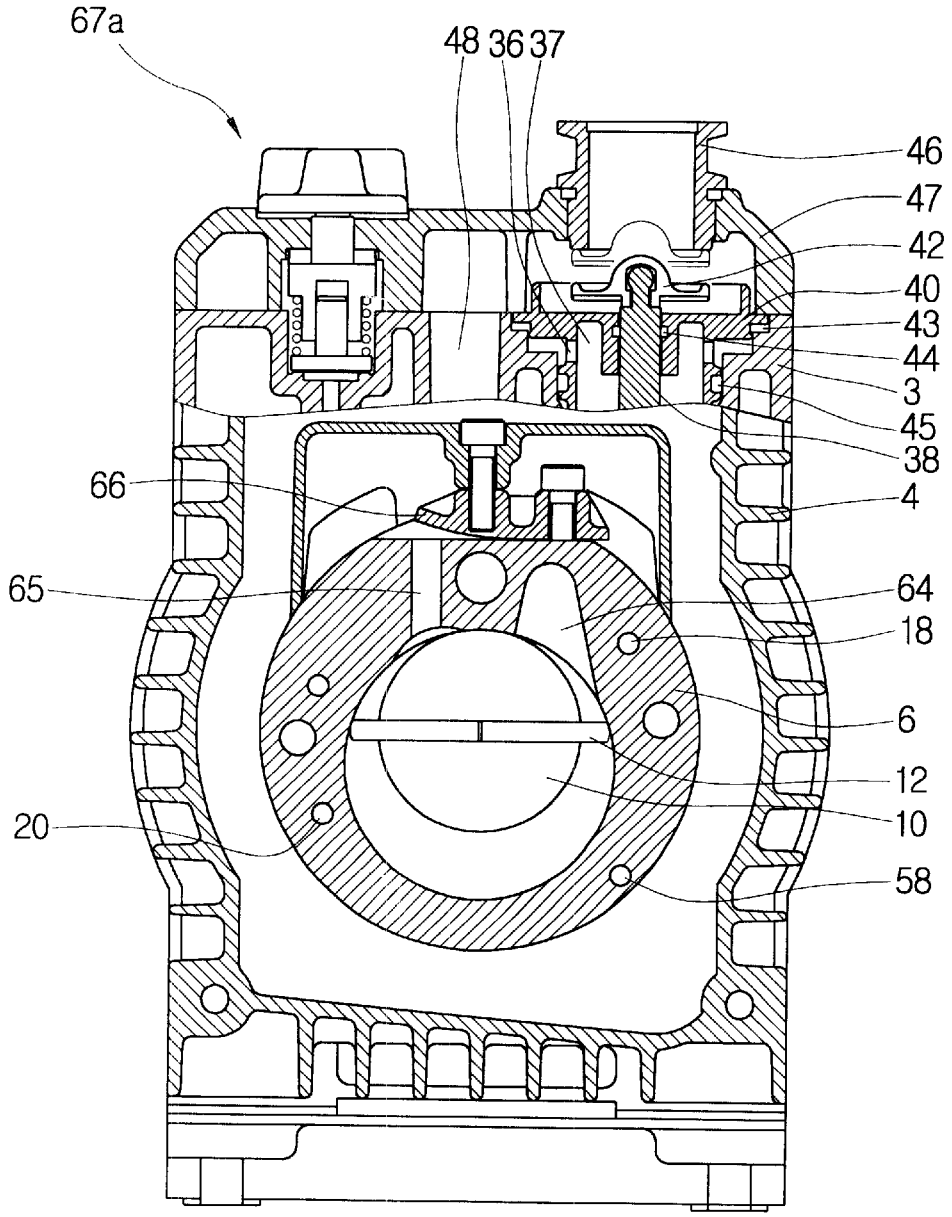
FIG. 2 is an one side cross-sectional view illustrating a vacuum pump apparatus according to the present invention.
Figure 3:
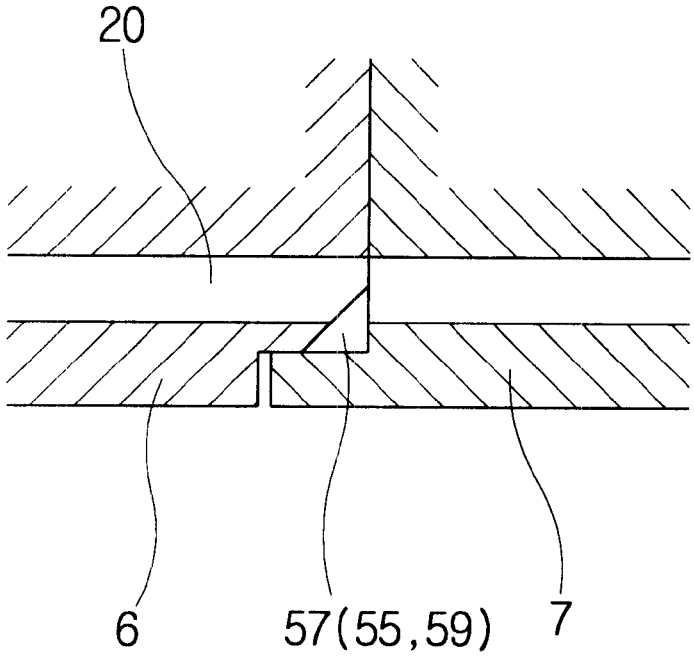
FIG. 3 is an enlarged view illustrating a seal structure according to the present invention.

FIG. 1 is a view illustrating a vacuum pump apparatus according to the present invention, FIG. 2 is a cross-sectional view illustrating a vacuum pump apparatus according to the present invention, and FIG. 3 is an enlarged view illustrating a sealing structure according to the present invention.

A pump apparatus 2(hereinafter referred to an apparatus surrounded by a pump apparatus and an oil storing casing, which is different from a vacuum pump apparatus which represents an entire construction of a pump apparatus) includes a first cylinder 5, a second cylinder 6, an oil pump housing 7, an oil pump cover 8, and first and second rotors 9 and 10 which rotate in the interior of the cylinder. In the pump apparatus 2, a certain cycle in which a gas is sucked into the cylinders 9 and 10 and is compressed therein using a certain vacuum facility(not shown) which is connected with a pump suction port 46 when vanes 11 and 12 of the rotors 9 and 10 each inserted in a vane groove of the rotor are contacted with the inner surfaces of the cylinders 5 and 6 is repeatedly performed. If an oil is continuously not supplied to an operating surface of the cylinders 5 and 6 and the rotors 9 and 10 of the pump apparatus 2, a vacuum performance will be significantly decreased due to a friction and gas leakage in each operating portion. In the worse case, the pump apparatus may be damaged. Therefore, an oil must be supplied to the operating portions based on a forced lubricating method.

The oil stored in an oil storing casing 4 is used for lubricating, sealing and cooling each operating portion of the pump apparatus. In order to supply the oil to the operating portions of the pump apparatus, an oil pump 13 and a lubricating oil flow path(oil supply path) are used. At this time, the oil pump 13 is capable of supplying an enough amount of oil more than the amount of oil needed for the pump apparatus and providing a good durability and high pressure.

An entrance 14 of an oil incoming path 15 of the oil pump 13 is directly contacted with an oil of the oil storing casing 4 and is formed in a lower portion of the oil pump cover 8 in such a manner that the oil is supplied to the pump apparatus 2 even when the amount of oil is small.

The oil pump 13 is installed in an oil pump housing 7 which supports a rotor shaft 16. The oil is supplied to each operating portion, a reverse flow prevention valve 42 and oil sealing spaces 55, 57 and 59 through oil flow paths 17, 18, 19, 20 and 55 which form a lubricating oil flow path.

A suction port 46 is installed in an upper cover 47 of the pump housing 3. A gas sucked from a vacuum facility into the suction space 48 through the pump suction port 46 is flown into the interior of the first cylinder 5 of the pump apparatus 2, compressed based on a rotation of the rotor, flown into the second cylinder 6 through a suction space 62, and then compressed by the rotor 10. The thusly compressed gas is flown into the casing 4 through a discharging hole 65 based on an opening of the discharging valve 66. The gas is flown to the outside from the casing 4 through the discharging port 78. At this time, if the vacuum pump 1 stops, an oil used for a lubrication, a polluted gas and an external air may be reverse—flown into the vacuum facility(not shown) connected with the interiors of the cylinders 5 and 6 of the pump apparatus and the suction spaces 48 and 62 and the suction port 46, so that it is impossible to implement a vacuum state in the system. In this case, a reverse flow prevention valve(non-return valve) 42*a* is installed in order to prevent the above-described problem.

As shown in FIG. 1, the reverse flow prevention valve 42*a* includes a valve plate 42 which is downwardly moved in a pump suction port space 46*a* for opening the pump suction port 46 when an oil pressure formed by the oil pump 13 is applied to the upper oil space 37 through the oil flow paths 17, 18, 34 and 35 and is upwardly moved for closing the pump suction port 46 when the pump apparatus stops, a piston 38 which is extended toward a lower side of the valve plate 42 and is downwardly moved when an oil pressure is applied to the upper oil space 37, a valve cover 40 for forming the upper oil space 37 and guiding a sliding operation of the piston 38 when the piston 38 is upwardly and downwardly moved, and a return spring 41 for elastically supporting the piston 38 in the lower oil space 27 for upwardly moving the piston 38 when the U-seal 39 and the O-rings 43, 44 and 45 stop.

The upper oil space 37 of the valve cover 40 is connected with an over pressure valve 22 installed at an end portion of the oil flow path 18 of the first cylinder 5 through valve operation paths 33, 34, 35 and 36. The over pressure valve 22 is connected with the oil flow paths 18 and 17, and the oil flow paths 17 and 18 are connected with the oil pump 13.

The oil pump 13 is constructed in such a manner that the flowing amount of oil is larger than the amount that the pump apparatus 1 needs. When the pump 1 is operated, the oil pump 13 is operated, and the oil is supplied through each oil flow path which forms the lubricating oil flow path. The remaining oil is returned to the oil storing casing 4. The oil having a pressure based on an operation of the oil pump 13 pushes the over pressure valve 22 through the oil flow paths 17 and 18, and the over pressure valve 22 is closely contacted with the surfaces of the housing 3 for thereby separating the oil flow path 26 and the oil flow 33. The pressure valve 24 elastically supported by the spring 25 is installed in the over pressure valve 22. When the pump apparatus 2 stops, and the pressure of oil is decreased, the pressure valve 24 closes the oil flow path 21 of the over pressure valve 22 based on an elastic force of the spring 25 and is moved to the oil flow path 18, so that the over pressure valve 22 is separated from the contact surface of the housing 3, whereby the over pressure valve 22 is separated from the contact surface of the housing 3. Therefore, the oil flow paths 26 and 33 are connected each other. The oil flow path 21 o the over pressure valve 22 has a larger diameter for thereby preventing a foreign substance from blocking the oil flow path 21. A certain oil pressure is maintained in the oil flow paths 17, 18, 19, 20, 56 and 58 based on the pressure valve 24 supported by a smaller diameter gap 23 of the over pressure valve and the spring 25. The over pressure valve 22 is moved by an oil pressure, and the oil flow paths 26 and 23 are separated from each other. The oil flow path 18 is connected with the oil flow paths 26 and 33 through an outer diameter gap 23 of the over pressure valve 22 and the oil flow path 21. The oil flown through the oil flow path 21 of the over pressure valve 22 backwardly moves the pressure valve 24 supported by the spring 25 and is flown into the lower oil space 27 exposed to the air through the oil flow paths 24a and 26 and is filled in the lower oil space 27. When the lower oil space 27 is full, the oil over-flown from the lower oil space 27 is returned to the oil storing casing 4, and the oil filled in the lower oil space 27 is supplied to a sliding bearing portion, a sleeve 30 and an oil seal 31 through the oil flow paths 29 and 32 for thereby implementing a lubricating and sealing operation and is returned to the oil storing casing 4 through an opened oil path 4. The oil flown through the outer diameter gap 23 of the over pressure valve 22 is flown through the oil flow paths 33, 34, 35 and 36 and is filled in the upper oil space 37 in the valve cover 40. When the oil is full in the upper oil space 37, the return spring 41 is compressed by an oil pressure which is applied to the oil flow paths 18 and 34, and the piston 38 is downwardly moved. The valve plate 42 attached to an upper portion of the piston 38 and closely contacting with a lower surface of the suction port 46 is separated(opened) from a lower surface(valve seat surface) of the suction port 46, so that the suction port 46 of the pump is connected with the cylinders 5 and 6 of the pump apparatus through the suction spaces 48 and 62. At this time, the oil filled in the upper oil space 37 formed by the valve cover 40 is not flown by the U-seal 39 and the O-ring 43 assembled to the piston and the O-rings 44 and 45 of the valve cover 40 for thereby preventing an oil pressure from being decreased.

The oil flow paths 33, 34, 35 and 36 and the upper oil space 37 have a certain size, respectively, and the oil flown by the oil pump 13 is fully filled in the oil flow paths 33, 34, 35 and 36 and the upper oil space 37 for thereby obtaining a certain time for obtaining a certain oil pressure. In this state, when the pump apparatus 2 operates, a vacuum state of the cylinders 5 and 6 of the pump apparatus 2 is obtained within a certain time required when a certain oil pressure is formed in the oil flow path and the upper oil space. Next, a certain oil pressure is formed in the oil flow path and the upper oil space 37, and the piston 38 is downwardly moved, and the valve plate 42 opens the suction port 46. Therefore, the liquid in the pump apparatus 2 is reverse-flown into the vacuum facility for thereby maintaining a vacuum state and preventing the system from being polluted.

In addition, the cross-sectional surface of the U-seal 39 assembled to the piston 38 which is upwardly and downwardly moved in the upper oil space 37 of the valve cover 40 is increased, so that the pressure applied to the U-seal 39 is increased even when the oil pressure in the oil flow paths 17 and 18 is lower for thereby downwardly moving the piston 38 supported by the return spring 41. The lower oil space 27 below the U-seal 39 is connected with the oil storing casing 4 through the oil flow path 28. Therefore, when the piston 38 is downwardly moved, the oil in the lower oil space 27 is quickly flown to the oil storing casing 4. When the piston 38 is upwardly moved, the air is inputted, so that the piston 38 is stably upwardly and downwardly moved. Even when the U-seal 39 is damaged, and the oil is flown from the upper oil space 37 to the lower oil space 27, the oil flown into the lower oil space 27 is not flown to the side of the pump suction port 46 and is returned to the oil storing casing 4 for thereby implementing a certain vacuum performance of the vacuum pump.

In the case that the pump stops, the oil pressures of the oil flow paths 17 and 18 are decreased, and the over pressure valve 22 which is closely contacted with the housing 3 and separates the oil flow paths 26 and 33 is backwardly moved by an elastic force of the spring 25 for thereby connecting the oil flow paths 26 and 33. Therefore, the upper oil space 37 communicates with the oil storing casing 4 of an atmospheric state for thereby decreasing the oil pressure. When the oil pressure is decreased, the piston 38 is quickly upwardly moved by an elastic force of the return spring 41, and the valve plate 42 closely contacting with the upper portion of the piston 38 tightly blocks the lower surface of the suction port 46 for thereby disconnecting the suction port 46 and the cylinders 5 and 6 of the pump apparatus, so that the oil used for lubricating and sealing the cylinders 5 and 6 and polluted gas are reverse-flown into the vacuum facility for thereby preventing the products and vacuum facility from being polluted. At this time, when the piston 38 is upwardly moved by an elastic force of the return spring 41, the oil in the oil space 37 is flown into the lower oil space 28 through the oil flow paths 36, 35, 34 and 33 and the oil flow path 26 communicating therewith and is returned to the oil storing casing 4 having an atmospheric state through the oil flow path 27. Here, since the over pressure valve 22 which connects and disconnects the oil flow paths 26 and 33 and the is quickly backwardly moved by an elastic force of the spring.

The oil flown by the oil pump 13 is flown along the oil flow paths 19, 20, 49 and 50 for thereby supplying an oil to the sliding bearing portions 53 and 54 of the rotors 9 and 10 and to the second cylinder 6 through the oil flow path 51 divided by the oil flow path 49. At this time, the oil supplied to the sliding bearings 53 and 54 and the second cylinder 6 performs a lubricating, sealing and cooling operation with respect to each operating portion. Thereafter, the oil and gas sucked from the vacuum facility through the hole of the discharging port 65 of the second cylinder 6 ate returned to the oil storing casing 4 based on an opening of the discharging valve 66. A lighter gas is discharged to the air or an additional recycling apparatus. In an operation of the pump apparatus 2, an oil pressure of the oil flow paths 18 and 20 is maintained by an outer diameter gap 23 of the over pressure and the spring 25, and the remaining oil is flown to the lower oil space 27 through the communicating hole 24*a* of the pressure valve 24 and the oil flow path 26. The oil filled in the lower oil space 27 is over-flown from the oil flow path 28 and is returned to the oil storing casing 4.

Circular oil seal spaces 59, 57 and 55 are formed in a boundary surface in which the first cylinder 5 and the second cylinder 6 are assembled, an assembling boundary surface of the oil pump housing 7 and an assembling boundary surface of the oil pump housing 7 and the oil pump cover 8. The circular oil seal spaces 55, 57 and 59 communicate with the oil flow paths 56 and 58. The oil supplied by the oil pump 13 is supplied to the oil seal spaces 55, 57 and 59, respectively. Since the oil is fully filled in the oil seal spaces 55, 57 and 59 by an oil pressure formed in the lubricating oil flow path and forms a certain seal space, so that it is possible to prevent a liquid from being flown into the interior of the pump through a gap formed when the members 5, 6, 7 and 8 are assembled. Therefore, the O-ring groove and O-ring which are formed and inserted for obtaining a sealing state in the surface of each part are not needed, so that the number of parts is decreased, and the fabrication is simplified, and a stable sealing state is obtained.

When the vacuum pimp 1 operates, the reverse flow prevention valve 42*a* is opened, and a gas is sucked from the vacuum facility(not shown) through the suction port 46. The thusly sucked gas is flown into the first cylinder 5 of the pump apparatus 2 through the suction path 48 of the housing 3. The fluid compressed by the first vane 11 of the first rotor 9 is discharged to the second cylinder 6 through the suction path 62. The fluid compressed by the second vane 12 of the second rotor 12 which rotates in the second cylinder 6 is discharged to the discharging hole 65 based on an opening of the discharging valve 66.

Figure 4:
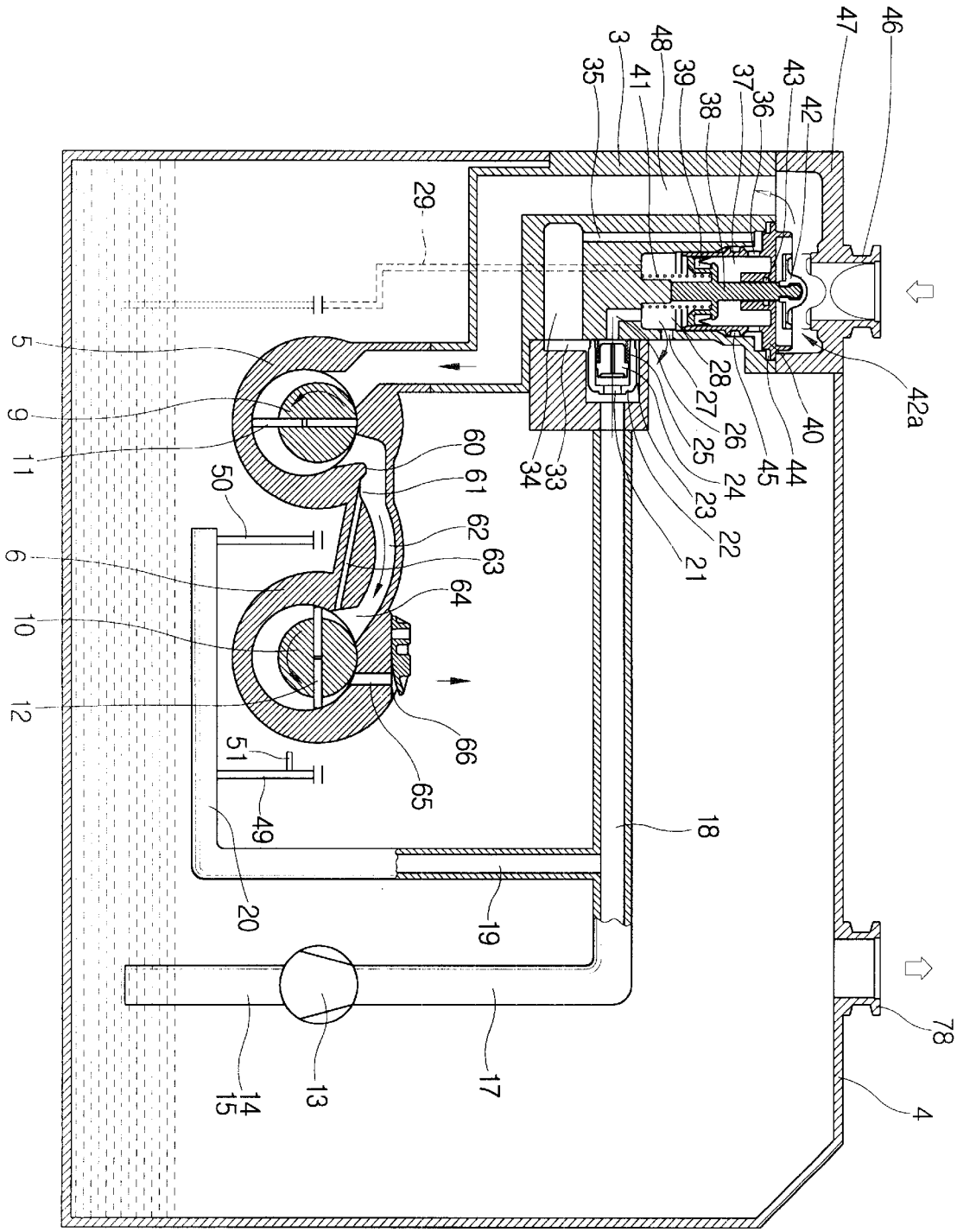
FIG. 4 is a view illustrating a cylinder of a vacuum pump apparatus according to the present invention.
Figure 5:
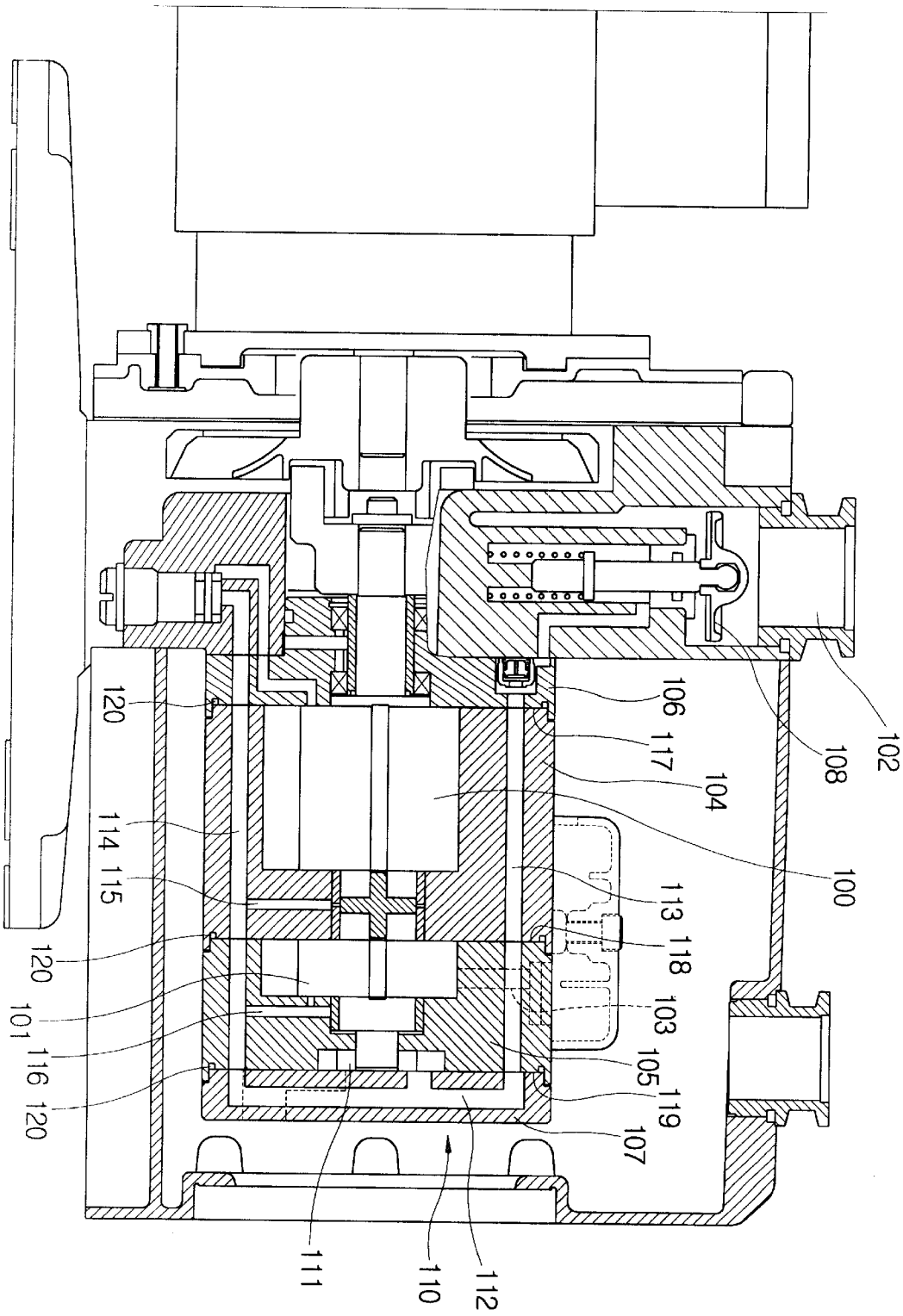
Fig.5 (Prior Art)
FIG. 5 is a view illustrating a seal structure of a conventional vacuum pump apparatus.

As shown in FIG. 4, a shoulder 60 is formed in the suction flow path 62 formed from the first cylinder 5 to the second cylinder 6. The fluid compressed by the first cylinder 5 and discharged into the second cylinder 6 is prevented from being flown to the first cylinder 5 for thereby implementing a certain efficiency and vacuum performance of the pump. The fluid which remains in a shoulder inner space 61 of the suction port 62 is flown toward the second cylinder 6 by connecting the suction port 64 of the second cylinder 6 and the shoulder inner space 61 based on a slanted suction path 63(the shoulder inner space 61 is formed at a higher portion), so that the remaining fluid is flown to the second cylinder 6 for thereby implementing a high efficiency and stable vacuum state.

In addition, if the oil in the oil storing casing 4 used for the lubricating, sealing and cooling operations with respect to each operating portion of the pump apparatus 2 is polluted by a compressed gas, the vacuum performance of the pump is decreased. Therefore, a new oil is needed. A gas filtering valve 67*a* is installed in the upper cover 47 in one side of the pump suction port 46 for filtering the polluted gas. The gas filtering valve 67*a* supplies a new air to the second cylinder 6 and filters the compressed gas included in the oil.

As described above, a small size oil seal space is formed in a circular shape in the assembling boundary surfaces of the apparatus in which the first cylinder, the second cylinder, the oil pump housing and the oil pump cover are sequentially assembled. The oil seal space is communicated with the oil flow path which guides the oil supplied from the oil pump to each operating portion of the pump apparatus, so that it is possible to seal the gaps of the assembling boundary surfaces based on a high oil pressure applied to the oil seal space for thereby enhancing a sealing effect and a vacuum state in the cylinder. In the present invention, the processes of the O-ring and O-ring groove are not needed. Therefore, the fabrication cost of the apparatus is decreased, and a certain maintenance effect is obtained for a sealing operation of the O-ring.

As the present invention may be embodied in several forms without departing from the spirit or essential characteristics thereof, it should also be understood that the above-described embodiments are not limited by any of the details of the foregoing description, unless otherwise specified, but rather should be construed broadly within its spirit and scope as defined in the appended claims, and therefore all changes and modifications that fall within the meets and bounds of the claims, or equivalences of such meets and bounds are therefore intended to be embraced by the appended claims.

What is claimed is:

1. A vacuum pump comprising:

a housing;

an oil pump cover;

an oil storage casing for storing leaking oil; and oil-sealing openings having a ring-shaped configuration and communicating with an oil passage for sealing gaps of ports thereof by oil pressure at the openings without use of an O-ring.

* * * * *